US005544935A

United States Patent [19]

Cone, II et al.

[11] Patent Number: 5,544,935

[45] Date of Patent: Aug. 13, 1996

[54] CARRIER APPARATUS

[75] Inventors: Richard E. Cone, II, Athens, Ohio; Alvin L. Fowler, Columbus, Ind.

[73] Assignee: Cosco, Inc., Columbus, Ind.

[21] Appl. No.: 326,483

[22] Filed: Oct. 20, 1994

[51] Int. Cl.[6] ..... A47D 3/02

[52] U.S. Cl. ..... 297/183.2; 16/110 R; 220/762; 297/183.4; 297/183.6

[58] Field of Search ..... 297/183.1, 183.2, 297/183.4, 183.6, 164; 16/110 R, 111 R; 220/757, 762, 765; 248/145.6

[56] References Cited

U.S. PATENT DOCUMENTS

| | | | |
|---|---|---|---|
| D. 353,288 | 12/1994 | Kain . | |
| 1,035,642 | 8/1912 | Rosse . | |
| 1,328,832 | 1/1920 | Hanarath . | |
| 1,557,263 | 10/1925 | Millen . | |
| 1,807,267 | 5/1931 | Winship . | |
| 2,259,077 | 10/1941 | Morgan | 16/111 R |
| 2,324,421 | 7/1943 | Ouellette . | |
| 2,675,860 | 4/1954 | Schroeder . | |
| 3,401,951 | 9/1968 | Bloom | 16/110 R X |
| 3,409,325 | 11/1968 | Hamilton et al. . | |
| 3,756,451 | 9/1973 | Dopeil | 220/762 X |
| 3,804,459 | 4/1974 | Nose . | |
| 3,857,604 | 12/1974 | Scott . | |
| 4,194,601 | 5/1980 | Yellin . | |
| 4,229,039 | 10/1980 | Day | 297/183.4 X |
| 4,324,430 | 4/1982 | Dimas, Jr. et al. . | |
| 4,371,206 | 2/1983 | Johnson, Jr. . | |
| 4,516,806 | 5/1985 | McDonald et al. | 297/183.6 X |
| 4,634,175 | 1/1987 | Wise . | |
| 4,688,850 | 8/1987 | Brownlie et al. . | |
| 4,711,490 | 12/1987 | Brand . | |
| 4,718,715 | 1/1988 | Ho . | |
| 4,746,165 | 5/1988 | Fuerst et al. . | |
| 5,143,419 | 9/1992 | Tepper et al. . | |
| 5,207,476 | 5/1993 | Payne . | |
| 5,324,094 | 6/1994 | Kain . | |

OTHER PUBLICATIONS

"What's News", Juvenile Merchandising, p. 16, May 1994.

*Primary Examiner*—Peter R. Crown
*Attorney, Agent, or Firm*—Barnes & Thornburg

[57] ABSTRACT

Carrier apparatus includes a handle mounted for rotation about an axis and limited axial movement in a middle portion of the frame. The frame is pivotably mounted to the infant seat. The frame is a generally U-shaped pivotable member including a first arm, a second arm, and a middle portion interconnecting first and second arms. The handle can be rotated about the axis to a selected angular position to change the angular orientation of the handle relative to the middle portion.

40 Claims, 1 Drawing Sheet

CARRIER APPARATUS

BACKGROUND AND SUMMARY OF THE INVENTION

This invention relates to carrier apparatus, and particularly to infant carriers. More particularly, this invention relates to carrying handles for infant car seats.

Carrying handles are usually provided for infant car seats to make it easy for parents or other caregivers to move an infant about while the infant is seated in the car seat. Typically, such carrying handles are pivotably attached to the bassinet portion of the car seat which is designed to hold an infant. See, for example, U.S. Pat. Nos. 5,207,476 to Payne and 5,324,094 to Kain.

Consumers would welcome a carrying handle that could be gripped and held comfortably. Many known carrying handles for infant car seats are awkward to hold, making it difficult for users to carry infant car seats outfitted with these handles. Some carrying handles are designed so that the user's palm will face forward toward the front of the infant or rearward toward the rear of the infant seat when the user grips the handle. Other carrying handles are configured to cause the user's palm to face toward one of the side walls of the infant seat. What is needed is a carrying handle that can be adjusted by each user to provide a comfortable hand grip having an angular orientation selected by the user.

According to the present invention, a carrier apparatus comprises a container and a carrying handle unit. The carrying handle unit includes a frame coupled to the shell and a handle rotatably coupled to the frame.

In preferred embodiments, the container is an infant car seat. The frame is generally U-shaped and has a round handle support platform, a first arm, and a second arm. The first arm has one end pivotably coupled to one side of the infant car seat and another end appended to a perimeter edge of the round handle support platform. The second arm also has one end pivotably coupled to another side of the infant car seat and another end appended to the perimeter edge of the round handle support platform.

The round handle support platform is formed to include a central aperture receiving the rotatable handle. The handle includes a ring-shaped base positioned to lie and rotate in the central aperture and a straight handle grip oriented to extend across a diameter of the ring-shaped base. Advantageously, the angular orientation or position of the handle grip can be adjusted by each user simply by rotating the handle manually about an axis relative to the handle support platform. Illustratively, the handle can be rotated 360° to allow the user to select the most comfortable angular position for the handle grip. Moreover, the user is able to change the orientation of the handle grip to a new angular position easily if such a change is thought to be desirable.

In addition, anti-rotation means is provided for automatically blocking rotation of the handle relative to the frame whenever a user is carrying the infant seat. The handle is mounted on the frame so that it can rotate in central aperture and move up and down in the central aperture along the axis of rotation of the handle. Illustratively, a first set of axially upwardly projecting teeth is appended to the handle and a second set of axially downwardly projecting teeth is appended to the frame.

Normally, whenever the infant car seat is at rest on a floor or the like, the first set of teeth on the ring-shaped base of the handle disengages the second set of teeth on the handle support portion of the frame to permit rotation of the handle relative to the frame. The weight of the handle causes the first set of teeth on the handle to move downwardly away from the second set of teeth on the handle support platform to disengage the anti-rotation means. Once a user grasps and lifts the handle and raises the infant car seat above the ground, the handle moves in an upward direction along its axis of rotation in the central aperture to engage the first and second sets of teeth in rotation-blocking interlocking relation so that the handle is unable to be rotated to a new angular orientation relative to the frame. Thus, the anti-rotation means is activated automatically every time a user lifts the infant seat by its grip handle.

Using a rotatable handle in accordance with the present invention, a user can easily adjust the angular orientation of the handle grip to a comfortable angular position selected by the user. Illustratively, the angular orientation of the handle grip can only be changed when the infant seat is at rest on the ground because the anti-rotation means provided between the handle and frame is actuated automatically by lifting the handle upwardly relative to the frame.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
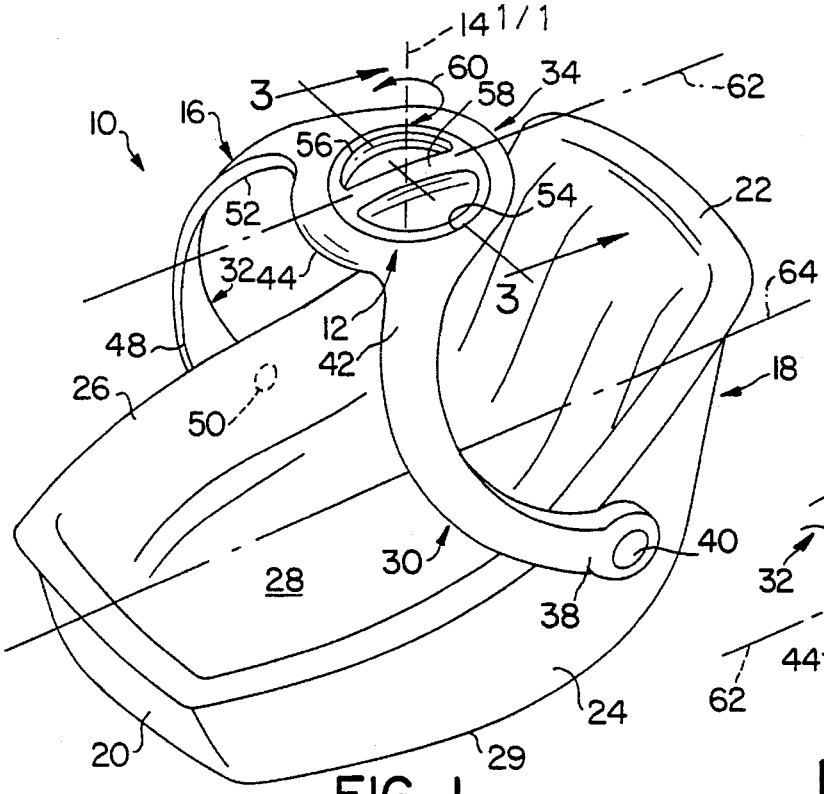
FIG. 1 is a perspective view of a carrier apparatus in accordance with the present invention showing a rotatable handle on a frame coupled for pivotable movement to an infant-carrying seat.

Carrier apparatus 10 shown in FIG. 1 includes a handle 12 that will rotate about an axis 14 to any comfortable carrying position. Handle 12 is mounted for rotation and limited axial movement in a middle portion of frame 16. Frame 16 is pivotably coupled to infant seat 18.

Infant seat 18 includes front wall 20, rear wall 22, and spaced-apart first and second side walls 24, 26 extending between the front and rear walls 20, 22 as shown in FIG. 1. A contoured seat surface 28 is provided between walls 20, 22, 24, and 26 to receive an infant (not shown). Infant seat 18 also includes a bottom wall 29 configured to set on the ground or other underlying surface.

Frame 16 is generally U-shaped as shown in FIG. 1 and includes a first arm 30, a second arm 32, and a bight portion 34 interconnecting the first and second arms 30, 32. First arm 30 includes a lower end 38 pivotably coupled to first side wall 24 at pivot point 40 and an upper end 42 appended to a perimeter edge 44 of bight portion 34. Second arm 32 includes a lower end 48 pivotably coupled to second side wall 26 at pivot point 50 and an upper end 52 appended to another portion of perimeter edge 44 as shown, for example, in FIG. 1. Frame 16 is pivotable about pivot points 40, 50 from the carrying position shown in FIG. 1 to a retracted position (not shown) in which handle 12 lies past and adjacent to rear wall 22. Any suitable mechanism (not shown) may be used to lock frame 16 in its carrying position and release it so that it can be moved manually to its retracted position.

Figure 2:
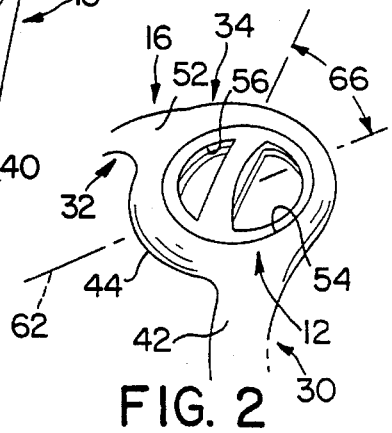
FIG. 2 is a view of a portion of the carrier apparatus of FIG. 1 showing counterclockwise rotation of the handle through a 45° angle relative to a round handle support platform in which the handle is mounted.

As shown in FIGS. 1 and 2, the bight portion 34 of frame 16 is a round disk shaped to define a handle support platform. A central aperture 54 is formed in handle support platform 34 to receive rotatable handle 12. Illustratively, handle 12 is positioned so that axis of rotation 14 passes through the center of central aperture 54. Also, the axis of rotation 14 of handle 12 will lie in substantially perpendicular relation to the bottom wall 29 of infant seat 18 when the frame 16 is pivoted to its carrying position shown in FIG. 1.

Handle 12 includes ring-shaped base 56 and elongated grip handle 58 as shown in FIGS. 1 and 2. Grip handle 58 includes one end appended to one portion of ring-shaped base 56 and another end appended to another portion of ring-shaped base 56. Grip handle 58 passes through axis 14 and is shaped to provide a comfortable hand grip for a person carrying infant seat 18. Handle 12 is illustratively made of molded plastics material.

Handle 12 is rotatable a full 360° about axis 14 as shown diagrammatically by arrow 60 in FIG. 1. Handle 12 can be rotated easily to the angular position shown in FIG. 1 in which grip handle 58 is aligned to extend along a horizontal axis 62 that is substantially parallel to a horizontal axis 64 extending longitudinally through infant seat 18. Conveniently, handle 12 can be rotated, for example, through 45° angle 66 as shown in FIG. 2 to assume a new angular orientation with respect to handle support platform 34.

Means is provided for blocking rotation of handle 12 about axis 14 relative to handle support platform 34 whenever someone is using handle 12 to carry infant seat 18 as shown in FIGS. 3–6. Such anti-rotation means minimizes the chance that the angular orientation of grip handle 58 will change during use of handle 12 to transport carrier apparatus 10.

Figure 3:
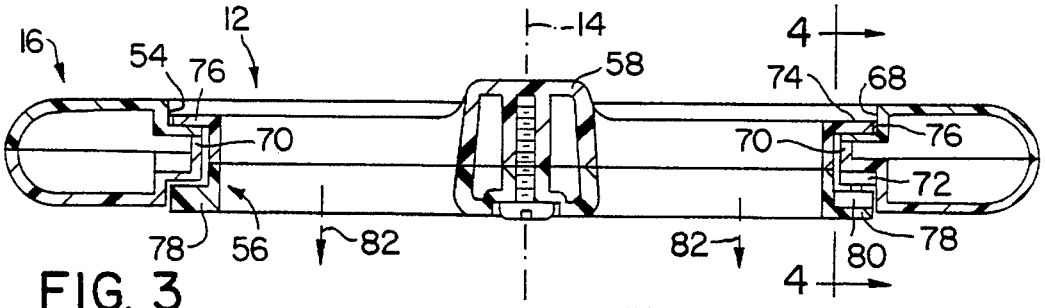
FIG. 3 is a sectional elevation view taken along line 3—3 of FIG. 1 when the carrier apparatus is at rest on the ground.
Figure 4:
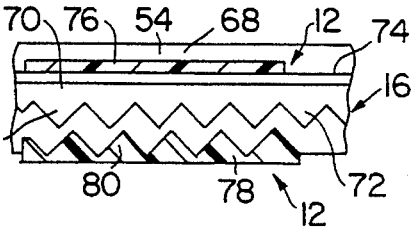
FIG. 4 is a sectional view taken along line 4—4 of FIG. 3 showing how the handle is able to be rotated freely relative to the handle support platform due to disengagement of upwardly projecting teeth on the handle and downwardly projecting teeth on the handle support platform.

As shown in FIGS. 3 and 4, round handle support platform 34 includes a circular inner edge 68 including a radially inwardly extending flange 70 formed to include a series of axially downwardly extending teeth 72 and an axially upwardly facing annular recessed rim 74. Ring-shaped base 56 includes a radially outwardly extending annular upper flange 76 and an underlying radially outwardly extending annular lower flange 78. A series of axially upwardly extending teeth 80 is formed on lower flange 78 and arranged to face toward axially downwardly extending teeth 72. Teeth 72 on handle support platform 34 are shaped and sized to mate in interlocking relation with teeth 74 on handle 12.

When carrier apparatus 10 is at rest on the ground as shown in FIG. 1, handle 12 is rotatable manually about axis 14 as shown in FIGS. 3 and 4. Rotation of handle 12 is possible in such a situation because the weight of handle 12 pulls handle 12 down in direction 82 to cause (1) annular upper flange 76 on handle 12 to engage recessed annular rim 74 and (2) teeth 80 on ring-shaped base 56 of handle 12 to disengage teeth 72 on annular flange 34 of handle support platform 34. In this situation, the anti-rotation means between handle 12 and handle support platform 34 is disengaged to permit handle 12 to rotate freely 360° about axis 14.

Figure 6:
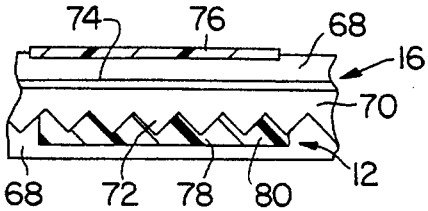
FIG. 6 is a sectional view taken along line 6—6 of FIG. 5 showing engagement of the teeth on the handle and teeth on the handle support platform to block rotation of the handle relative to the handle support platform whenever a user is carrying the carrier apparatus.
Figure 5:
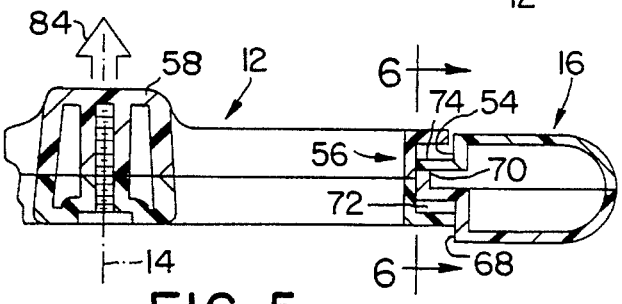
FIG. 5 is a view similar to FIG. 3 showing upward movement of the handle relative to the handle support platform in response to a user grasping the grip handle and raising the carrier apparatus off the ground.

The anti-rotation means is activated whenever a user raises carrier apparatus 10 off the ground by lifting grip handle 58 as shown in FIGS. 5 and 6. Once grip handle 58 is lifted in direction 84, annular upper flange 76 on ring-shaped base 56 is raised upwardly away from underlying annular recessed rim 74 on handle support platform 34 and teeth 80 are raised to engage teeth 72 as shown in FIG. 6. Such engagement functions to interlock teeth 72 and 80 and block rotation of handle 12 relative to handle support platform.

Although the invention has been described in detail with reference to a certain preferred embodiment, variations and modifications exist within the scope and spirit of the invention as described and defined in the following claims.

We claim:

1. A carrier apparatus comprising a container having an exterior bottom wall, a frame coupled to the container, and a lifting handle rotatably mounted on the frame and configured for rotation about an axis that is generally perpendicular to the exterior bottom wall of the container to a plurality of fixed discrete positions, each position of which varies the orientation of the lifting handle with respect to the carrier to permit lifting of the carrier by the lifting handle in any of the positions.

2. The carrier apparatus of claim 1, wherein the container further includes first and second side walls coupled to the exterior bottom wall and arranged to lie in spaced-apart relation to define an infant-carrying seat therebetween, the frame includes a handle support platform, a first arm interconnecting the handle support platform and the first side wall, and a second arm interconnecting the handle support platform and the second side wall, and the handle is rotatably mounted on the handle support platform.

3. The carrier apparatus of claim 2, wherein the handle support platform is positioned to lie between the first and second side walls and above the infant-carrying seat.

4. The carrier apparatus of claim 3, wherein the handle support platform is a round disk formed to include a central aperture and the handle is positioned to lie and rotate in the central aperture.

5. The carrier apparatus of claim 2, wherein the handle support platform is a round disk formed to include a central aperture and the handle is positioned to lie and rotate in the central aperture.

6. The carrier apparatus of claim 1, wherein the frame includes a handle support platform formed to include a central aperture and the handle is positioned to lie and rotate in the central aperture.

7. The carrier apparatus of claim 6, wherein the handle support platform is a round disk.

8. A carrier apparatus comprising a container having an exterior bottom wall, a frame coupled to the container, and a handle rotatably mounted on the frame for rotation about an axis that is generally perpendicular to the exterior bottom wall of the container, the container further including first and second side walls coupled to the exterior bottom wall and arranged to lie in spaced-apart relation to define an infant-carrying seat therebetween, the frame including a handle support platform, a first arm interconnecting the handle support platform and the first side wall, and a second arm interconnecting the handle support platform and the second side wall, and the handle being rotatably mounted on the handle support platform, the handle support platform being a round disk formed to include a central aperture and the handle being positioned to lie and rotate in the central aperture, the handle including a ring-shaped base positioned to lie and rotate in the central aperture and a handle grip appended to the ring-shaped base and oriented to extend across a diameter of the ring-shaped base.

9. A carrier apparatus comprising a container having an exterior bottom wall, a frame coupled to the container, and a handle rotatably mounted on the frame for rotation about an axis that is generally perpendicular to the exterior bottom wall of the container, the frame including a handle support platform formed to include a central aperture and the handle being positioned to lie and rotate in the central aperture, the handle including a ring-shaped base and an elongated handle grip having a first end appended to one portion of the ring-shaped base and a second end appended to another portion of the ring-shaped base.

10. The carrier apparatus of claim 9, wherein the handle grip is a straight member oriented to extend along a diameter of the ring-shaped base.

11. A carrier apparatus comprising a container having an exterior bottom wall, a frame coupled to the container, a lifting handle rotatably mounted on the frame and configured for rotation about an axis that is generally perpendicular to the exterior bottom wall of the container to a plurality of discrete positions, each position of which varies the orientation of the lifting handle with respect to the carrier to permit lifting of the carrier by the lifting handle in any of the positions, and anti-rotation means for selectively blocking rotation of the handle relative to the frame about the axis in response to movement of the handle away from the frame in a direction along the axis.

12. A carrier apparatus comprising a container having an exterior bottom wall, a frame coupled to the container, a handle rotatably mounted on the frame for rotation about an axis that is generally perpendicular to the exterior bottom wall of the container, and anti-rotation means for selectively blocking rotation of the handle relative to the frame about the axis, the anti-rotation means including a first set of axially downwardly projecting teeth appended to the handle and a second set of axially upwardly projecting teeth appended to the frame and configured to engage the first set of axially downwardly projecting teeth in rotation-blocking interlocking relation upon movement of the handle in an axially upward direction away from the container and along the axis.

13. A carrier apparatus comprising a container, a U-shaped frame coupled to the container, the U-shaped frame being formed to include a central aperture, and a lifting handle rotatably mounted in the central aperture formed in the U-shaped frame and configured for rotation to a plurality of fixed discrete positions, each position of which varies the orientation of the lifting handle with respect to the carrier to permit lifting of the carrier by the lifting handle in any of the positions.

14. The carrier apparatus of claim 13, wherein the U-shaped frame includes a first arm, a second arm, and a bight portion between the first and second arms, and the bight portion is formed to include the central aperture.

15. The carrier apparatus of claim 14, wherein the container includes first and second side walls arranged to lie in spaced-apart relation and an infant-carrying seat between the first and second side walls, the first arm is coupled to the first side wall, and the second arm is coupled to the second side wall.

16. The carrier apparatus of claim 14, wherein the bight portion is a round disk formed to include the central aperture therein and each arm has one end appended to a perimeter edge of the round disk.

17. The carrier apparatus of claim 13, wherein the handle includes a round base and a grip handle appended to the round base.

18. A carrier apparatus comprising a container, a U-shaped frame coupled to the container, the U-shaped frame being formed to include a central aperture, and a handle rotatably mounted in the central aperture formed in the U-shaped frame, the U-shaped frame including a first arm, a second arm, and a bight portion between the first and second arms, and the bight portion being formed to include the central aperture, the handle including a ring-shaped base positioned to lie and rotate in the central aperture and a handle grip appended to the ring-shaped base and oriented to extend across a diameter of the ring-shaped base.

19. A carrier apparatus comprising a container, a U-shaped frame coupled to the container, the U-shaped frame being formed to include a central aperture, and a handle rotatably mounted in the central aperture formed in the U-shaped frame, the handle including a round base and a grip handle appended to the round base, the grip handle including a first end appended to one portion of the round base, a second end appended to another portion of the round base, a first side edge extending between the first and second ends, and a second side edge extending between the first and second ends and lying in spaced-apart relation to the first side edge, and the round base is formed to include a first hand-receiving aperture adjacent to the first side edge and a second hand-receiving aperture adjacent to the second side edge.

20. A carrier apparatus comprising a container, a U-shaped frame coupled to the container, the U-shaped frame being formed to include a central aperture, and a handle rotatably mounted in the central aperture formed in the U-shaped frame, the handle including a round base and a grip handle appended to the round base wherein the round base is a ring formed to include a central aperture and the grip handle is a straight member arranged to extend across a diameter of the ring and lie in the central aperture of the ring.

21. A carrier apparatus comprising a container, a U-shaped frame coupled to the container, the U-shaped frame being formed to include a central aperture, a lifting handle rotatably mounted in the central aperture formed in the U-shaped frame and configured for rotation to a plurality of discrete positions, each position of which varies the orientation of the lifting handle with respect to the carrier to permit lifting of the carrier by the lifting handle in any of the positions, and anti-rotation means for selectively blocking rotation of the handle relative to the frame about the axis in response to movement of the handle away from the frame in a direction along the axis.

22. A carrier apparatus comprising a container, a U-shaped frame coupled to the container, the U-shaped frame being formed to include a central aperture, a handle rotatably mounted in the central aperture formed in the U-shaped frame, and anti-rotation means for selectively blocking rotation of the handle relative to the frame about the axis, the anti-rotation means including a first set of axially downwardly projecting teeth appended to the handle and a second set of axially upwardly projecting teeth appended to the frame and configured to engage the first set of axially downwardly projecting teeth in rotation-blocking interlocking relation upon movement of the handle along an axis in an axially upward direction away from the container.

23. An infant carrier apparatus comprising a shell formed to include an infant-receiving seat, and a carrying handle unit including a frame pivotally coupled to the shell and a lifting handle rotatably coupled to the frame and configured for rotation to a plurality of fixed discrete positions, each position of which varies the orientation of the lifting handle with respect to the carrier to permit lifting of the carrier by the lifting handle in any of the positions.

24. The infant carrier apparatus of claim 23, wherein the frame includes a handle support platform, a first arm having one end appended to the handle support platform and another end pivotally coupled to the shell, and a second arm having one end appended to the handle support platform and another end pivotally coupled to the shell, and the handle is rotatably coupled to the handle support platform.

25. The infant carrier apparatus of claim 24, wherein the handle support platform has a round perimeter edge and the one end of each of the first and second arms is appended to the round perimeter edge.

26. The infant carrier apparatus of claim 24, wherein the handle support platform is formed to include a central aperture and the handle is positioned to lie and rotate in the central aperture.

27. An infant carrier apparatus comprising a shell formed to include an infant-receiving seat, and a carrying handle unit including a frame pivotally coupled to the shell and a handle rotatably coupled to the frame, the frame including a frame support platform, a first arm having one end appended to the frame support platform and another end pivotally coupled to the shell, and a second arm having one end appended to the handle support platform and another end pivotally coupled to the shell, and the handle being rotatably coupled to the handle support platform, the handle support platform being formed to include a central aperture and the handle being positioned to lie and rotate in the central aperture, the handle including a ring-shaped base positioned to lie and rotate in the central aperture and a handle grip appended to the ring-shaped base and oriented to extend across a diameter of the ring-shaped base.

28. An infant carrier apparatus comprising a shell formed to include an infant-receiving seat, a carrying handle unit including a frame pivotally coupled to the shell and a lifting handle rotatably coupled to the frame and configured for rotation to a plurality of discrete positions, each position of which varies the orientation of the lifting handle with respect to the carrier to permit lifting of the carrier by the lifting handle in any of the positions, and anti-rotation means for selectively blocking rotation of the handle relative to the frame about the axis in response to movement of the handle away from the frame in a direction along the axis.

29. An infant carrier apparatus comprising a shell formed to include an infant-receiving seat, a carrying handle unit including a frame pivotally coupled to the shell and a handle rotatably coupled to the frame, and anti-rotation means for selective blocking rotation of the handle relative to the frame about the axis, the anti-rotation means including a first set of axially downwardly projecting teeth appended to the handle and a second set of axially upwardly projecting teeth appended to the frame and configured to engage the first set of axially downwardly projecting teeth in rotation-blocking interlocking relation upon movement of the handle along an axis in an axially upward direction away from the container.

30. A carrier apparatus handle comprising a handle frame having a transversely extending portion, a separate displaceable lifting handle for carrying an apparatus having longitudinally extending portion, the separate displaceable handle being coupled to the handle frame for selective angular displacement relative to the handle frame, and a handle displacement blocker mechanism coupled to the handle frame and the separate displaceable handle to block displacements of the handle relative to the handle frame and align and maintain the longitudinally extending portion of the lifting handle at any selective displacement angle relative to the transversely extending portion of the handle frame.

31. The carrier apparatus handle of claim 30, wherein the transversely extending portion includes an upper end of a first arm, an upper end of a second arm, and a bight portion interconnecting the upper ends of the first and second arms, and the handle displacement blocker mechanism is coupled to the bight portion of the handle frame to block displacement of the handle relative to the bight portion.

32. A carrier apparatus comprising a container having an exterior bottom wall, a frame coupled to the container, the frame including a first arm, a second arm, a handle support platform interconnecting the first and second arms, the handle support platform defining a central aperture extending therethrough, and a lifting handle including a ring-shaped base and a grip handle, the ring-shaped base of the lifting handle being rotatably mounted within the central aperture for rotation about an axis of rotation, the grip handle being mounted to the ring-shaped base to intercept the axis of rotation of the ring-shaped base and arranged to lie wholly within the central aperture formed in the handle support platform during rotation of the ring-shaped base about the axis of rotation.

33. The apparatus of claim 32, further comprising means for blocking rotation of the ring-shaped base about the axis of rotation relative to the handle support platform when the lifting handle is lifted to carry the container.

34. A carrier apparatus comprising a container having an exterior bottom wall, a frame coupled to the container, the frame including a first arm, a second arm, a handle support platform interconnecting the first and second arms, the handle support platform defining a central aperture extending therethrough, and a lifting handle including a ring-shaped base and a grip handle, the ring-shaped base of the lifting handle being rotatably mounted within the central aperture for rotation about an axis of rotation, the grip handle being mounted to the ring-shaped base to intercept the axis of rotation of the ring-shaped base and the grip handle including one end appended to one portion of the ring-shaped base and another end appended to another portion of the ring-shaped base.

35. The apparatus of claim 34, wherein the ring-shaped base includes an annular outer perimeter edge abutting the handle support platform and an annular inner perimeter edge including said one portion and said another portion.

36. The apparatus of claim 35, wherein the handle support platform includes a circular inner edge configured to guide movement of the ring-shaped base 360° about the axis of rotation.

37. A carrier apparatus comprising a container having an exterior bottom wall, a frame coupled to the container, and a lifting handle rotatably mounted on the frame for rotation about an axis of rotation generally perpendicular to the exterior bottom wall of the container, the lifting handle including a base and an elongated grip handle mounted on the base, the grip handle having opposite ends and a center portion and the center portion of the lifting handle is configured for intercepting the axis and the base is configured for rotation about the axis to vary the orientation of the grip handle with respect to the carrier permitting lifting of the carrier by the lifting handle.

38. The carrier apparatus of claim 37, wherein the container further includes first and second side walls coupled to the exterior bottom wall and arranged to lie in spaced-apart relation to define an infant-carrying seat therebetween and the frame includes a handle support platform, a first arm interconnecting the handle support platform and the first side wall, and a second arm interconnecting the handle support platform and the second side wall.

39. The carrier apparatus of claim 38, wherein the handle support platform is positioned to lie between the first and second side walls and above the infant-carrying seat.

40. The carrier apparatus of claim 39, wherein the handle support platform is a round disk formed to include a central aperture and the lifting handle is positioned to lie and rotate in the central aperture.

* * * * *